US008939261B2

(12) United States Patent
De Angelis

(10) Patent No.: US 8,939,261 B2
(45) Date of Patent: Jan. 27, 2015

(54) SUPPORT ELEMENT SYSTEM FOR ELEVATORS

(75) Inventor: Claudio De Angelis, Munster (DE)

(73) Assignee: Inventio AG, Hergiswil (CH)

( * ) Notice: Subject to any disclaimer, the term of this patent is extended or adjusted under 35 U.S.C. 154(b) by 466 days.

(21) Appl. No.: 13/081,133

(22) Filed: Apr. 6, 2011

(65) Prior Publication Data

US 2011/0247902 A1 Oct. 13, 2011

(30) Foreign Application Priority Data

Apr. 12, 2010 (EP) ..... 10159657

(51) Int. Cl.

| | |
|---|---|
| ***B66B 11/04*** | (2006.01) |
| ***B66B 7/06*** | (2006.01) |
| ***D07B 1/16*** | (2006.01) |
| ***D07B 1/22*** | (2006.01) |
| *D07B 5/00* | (2006.01) |

(52) U.S. Cl.

CPC . *B66B 7/062* (2013.01); *B66B 7/06* (2013.01); *D07B 1/16* (2013.01); *D07B 1/22* (2013.01); *D07B 5/005* (2013.01); *D07B 2201/1092* (2013.01); *D07B 2401/2015* (2013.01); *D07B 2501/2007* (2013.01)

USPC ..... 187/251

(58) Field of Classification Search

CPC ..... B66B 11/00; B66B 11/04; B66B 11/08

USPC ..... 187/251, 255, 266

See application file for complete search history.

(56) References Cited

U.S. PATENT DOCUMENTS

| | | | | |
|---|---|---|---|---|
| 2008/0116014 | A1 * | 5/2008 | Ach | 187/252 |
| 2010/0133046 | A1 * | 6/2010 | Allwardt et al. | 187/251 |
| 2010/0243378 | A1 * | 9/2010 | Begle | 187/254 |

FOREIGN PATENT DOCUMENTS

| | | | |
|---|---|---|---|
| DE | 102004047158 | A1 | 3/2006 |
| DE | 202008001786 | U1 | 12/2008 |
| EP | 1061172 | A2 | 12/2000 |
| WO | WO 2008110241 | A2 * | 9/2008 |
| WO | 2008135317 | A1 | 11/2008 |
| WO | 2010072690 | A1 | 7/2010 |

* cited by examiner

*Primary Examiner* — William E Dondero
*Assistant Examiner* — Diem Tran
(74) *Attorney, Agent, or Firm* — Fraser Clemens Martin & Miller LLC; William J. Clemens

(57) ABSTRACT

A support element system, particularly for elevators, has at least one support element having two load-bearing tensile carriers which are arranged horizontally adjacent to one another and which are enclosed in a common elastomeric casing separating the two tensile carriers. The tensile carriers respectively have an opposite direction of wrap. The system has a drive pulley for transmission of a drive force to the at least one support element, wherein the drive pulley has a contoured traction surface with two support surfaces, which are provided for transmission of the drive force and which co-operate with the support element.

10 Claims, 3 Drawing Sheets

SUPPORT ELEMENT SYSTEM FOR ELEVATORS

CROSS-REFERENCE TO RELATED APPLICATION

This application claims priority to European Patent Application No. 10159657.5, filed Apr. 12, 2010, which is incorporated herein by reference.

FIELD

The present disclosure relates to a support element, particularly for elevators, with a support element and a drive pulley co-operating with the support element, as well as to an elevator with a corresponding support element system.

BACKGROUND

In conventional elevator installations the elevator cage and a counterweight are connected together by way of several cables or belts. The counterweight and the cage are supported and, as a rule, also moved by the cables or belts. For this purpose, drive force generated by a drive is transmitted by way of a drive pulley to the cables or belts. When the drive pulley rotates, the cable or the belt is guided over the drive pulley and thus raises or lowers the elevator cage or counterweight. In this connection, the drive moment is imposed under friction couple on the respective cable or belt section lying on the drive pulley over the looping angle.

In order to ensure a force transmission which is as efficient as possible, selection can be made of materials with a high co-efficient of friction which can be used not only on the drive pulley, but also as cable material. In addition, good guidance of the cable or belt and an efficient transmission of force are achieved by a drive pulley which follows a contour of the cable or belt so that large parts of the cable or belt surface are in contact with the drive pulley. For this purpose the surface shapes of the cable and the drive pulley have to be precisely matched to one another, since otherwise different pressures of the drive pulley on the cable of the belt occur, whereby different material loads arise in the cable or belt and therefore different levels of wear phenomena.

Moreover, in the case of different loading a uniform transmission of force to the cable or belt is not possible, so that in certain circumstances lateral forces or shear forces arise which can lead to cable torsion or cable unraveling phenomena, which in turn disrupt the cable structure in terms of its balance. Twist phenomena of that kind can occur particularly when the drive pulley or cable rollers are arranged at an angle.

A cable with two tensile carriers in an elastomeric casing is known from EP 1 061 172, wherein the elastomeric casing has an outer contour which co-operates with corresponding grooves in the drive pulley. Specifically, the cable is held by a rib, which is formed in cable longitudinal direction, in co-operation with a guide groove shape, which is provided to be complementary therewith, on the drive pulley in the track.

SUMMARY

There is therefore a need for ensuring a uniform and focused transmission of force from the drive pulley to the support element.

Accordingly, one aspect relates to a support element system, particularly for elevators, with at least one support element having exactly two load-bearing tensile carriers, which are arranged horizontally adjacent to one another and which are enclosed in a common elastomeric casing separating the two tensile carriers. The tensile carriers respectively have an opposite direction of wrap in which the maximum width and the maximum height of the cross-section of the support element have substantially a ratio of 1:1. The vertical orientation of the tensile carriers is to half the height of the cross-section of the support element, The system includes a drive pulley for transmission of a drive force to the at least one support element, wherein the drive pulley has a contoured traction surface with two support surfaces which are provided for transmission of the drive force and which co-operate with the support element.

The innovation described herein is based on the recognition that a uniform transmission of the drive force to the support element can be carried out in that the drive pulley has specific regions which are provided for the transmission of the drive force. For this purpose, the traction surface of the drive pulley is contoured so that specific surfaces arise which co-operate with the support element when it runs over the drive pulley. It is thereby achieved that the entire surface of the drive pulley does not co-operate with the support element for the force transmission, but that the force transmission takes place selectively at specific places.

The support element has a special construction for the selective transmission. The load-bearing tensile carriers, which are arranged horizontally adjacent to one another, respectively have an opposite direction of wrap. This means that the wires or fibers from which the tensile carriers are formed are twisted around in one case to the left and in the other case to the right. A torque is usually exerted on the cable by the wrap direction of a tensile carrier. Due to the fact that the tensile carriers in the support element, the torques are mutually canceling, since they are oriented against one another. When the support element runs over the support pulley, the support element is thus adjusted so that a defined surface of the support element co-operates with the surface of the drive pulley. In addition, the support element is balanced, so that the force is transmitted uniformly from the drive pulley to the two transmission surfaces.

In this connection, the tensile carriers or the cords are arranged with axial symmetry. The tensile carriers are then arranged horizontally adjacent to one another. The support element or the cable thus has a vertical axis of symmetry and a horizontal axis of symmetry. By virtue of this configuration the cable or support element is self-adjusting on the drive pulley so that it is optimally oriented with respect to the force transmission. In that regard, compensation is provided for the inherent torque of the cable and the external torque of the support pulley or of cable rollers. Overall, service life is thereby extended since the force transmission is optimized and no undesired different and thus premature abrasion takes place. In addition, it is advantageous that the cable rollers can be positioned at an angle. The support element self adjusts in its position even in the case of an angled setting of the cable rollers.

Apart from the self-adjustment it is of advantage that the cords, which are arranged horizontally adjacent to one another, are mutually supporting and thus ensure internal cable stability, which guarantees a uniform transmission of force.

The casing can be of different construction. For example, the surface can be shaped in such a manner that it forms a polygon in the cross-section of the cable. Specially formed regions, which can co-operate with the support surfaces of the traction surface, thereby arise in the support element. Ideally, the surface of the support element is so constructed that it is oriented in parallel to the support surfaces of the traction surface. In this connection, the angle in relation to the horizontal can be formed to be between 30 and 60°. The casing can be formed from an elastomeric polymer such as, for example, polyurethane or EPDM. The advantage of a surface of that kind is that a high capability of traction is imparted.

In cross-section the support element has a height/width ratio substantially of 1:1. In this embodiment, the two oppositely wrapped tensile carriers form the stabilizing horizontal axis, and profiles, for example longitudinal or transverse profiles, can be formed on the horizontal surface. The longitudinal profiles can, for example, serve the purpose of conducting away moisture and dirt. The transverse profiles ensure a lower bending stress in the support element, which overall leads to lower wear.

The coefficient of friction can also be reduced by an appropriate design of the transverse profiles. A friction element built up by way of the support pulley is interrupted by the transverse profiles, whereby overall a lower coefficient of friction arises. This has the advantage that the cable can slip over the drive pulley. At the same time, however, a high pressure which is good for traction is produced on the support element by the support surfaces. In this connection, the force is accepted by the elastomeric polymer. The polymer can have different degrees of hardness depending on which property is desired. By virtue of the transverse profiles the hardness of the polymer can be increased, since good bending can nevertheless be achieved. Overall, through variation of the cross-section of the support element and of the drive pulley and variation of the hardness of the polymer the traction capability in the entire system can be adjusted. The readiness of the support elements for discard can advantageously be determined by way of profile depth measurement of the profiles. The profiles can themselves be matched in their dimension and spacing to the drive pulley diameter. In this regard, the profiles can also be arranged alternately on the opposite sides of the cable.

The support element co-operates with the two support elements in such a manner that the forces transmitted from the drive pulley to the support element cross at the vertical axis determined by the support element itself. The vertical axis of the support element in this regard runs precisely between the two tensile carriers. The forces thus act at any point in time symmetrically on the inherently symmetrical support element, so that an optimal adjustment can take place.

BRIEF DESCRIPTION OF THE DRAWINGS

The various embodiments of the disclosed technology will be explained in more detail symbolically and by way of example on the basis of the figures. The figures are described conjunctively and in general, wherein.

DETAILED DESCRIPTION

Figure 1:
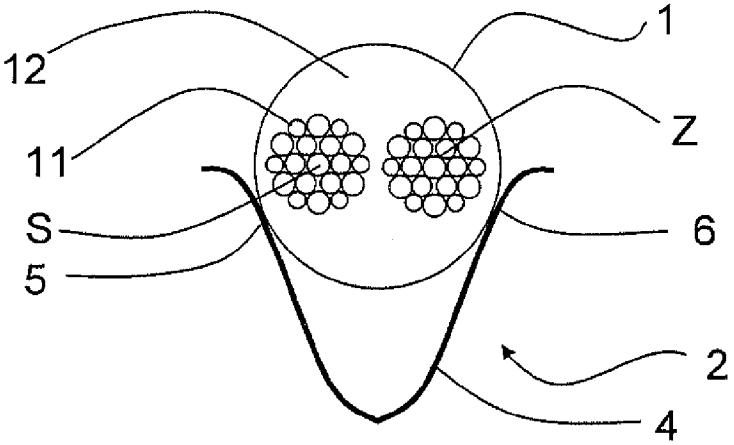
FIG. 1 shows a support element with round cross-section and a contoured drive pulley.

FIG. 1 shows an exemplary support element 1, which is illustrated in cross-section. The support element has two tensile carriers 11 which are surrounded by an elastomeric casing. The tensile carriers 11 are arranged horizontally in the cross-section in the support element. The two tensile carriers are separated from one another by the elastomeric material 12. The support element has a symmetrical construction as seen in cross-section both in vertical direction and horizontal direction. The tensile carriers 11 have a wrap in opposite direction S, Z. This means that twisting of metal wires to form strands and then twisting of strands to form cords is carried out in the two tensile carriers respectively in opposite direction. If the tensile carriers are of fiber material, then the twisting is similarly in the indicated configuration. In that regard, any cable configurations with wires, strands, which are twisted to form cords are conceivable. The opposite direction of wrap S, Z has the consequence that the torques of the tensile carriers are mutually canceling.

The position of the cable is thereby stabilized when running over the support pulley and the cable or support element automatically self adjusts to the support surfaces 5, 6 of the traction surface 4 of the drive pulley. The wires or synthetic material fibers are preferably all wrapped in parallel within a tensile carrier, thus, for example, all in S direction or all in Z direction. A maximization of the possible reverse bending during operation of the elevator is thereby achieved. For optimal orientation the cable is of symmetrical construction so that the two tensile carriers 11 are formed in such a manner that the number of wires, threads or strands used in the two cords is identical. The cable or support element 1 during running now runs over the drive pulley 2 on the two support surfaces 5 and 6 and there automatically self-adjusts in its horizontal position. The transmission of force takes place between the surface of the support element and the two support surfaces 5 and 6. In this connection, the forces act symmetrically on the cable so that they intersect at the vertical axis of symmetry formed by the cable. A uniform and selective transmission of force from the drive pulley to the support element is thus guaranteed.

Figure 2:
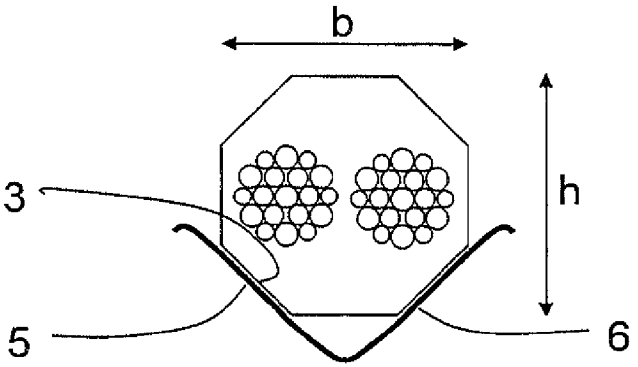
FIG. 2 shows a support element with polygonal cross-section and a drive pulley.

FIG. 2 shows an exemplary construction of the support element in which the support element has a polygonal shape in cross-section. The support element thereby has on the surface planar or flat regions 3 which extend over the entire length of the support element. The support on the drive pulley is thereby improved, because the drive pulley and support element co-operate over a larger region. However, this is guaranteed only when the surface of the support element is formed parallel to the surface of the drive pulley. A defined and uniform transmission of force is also made possible by the defined support surface. In that case the height h is substantially equal to the width b of the support element.

Figure 3:
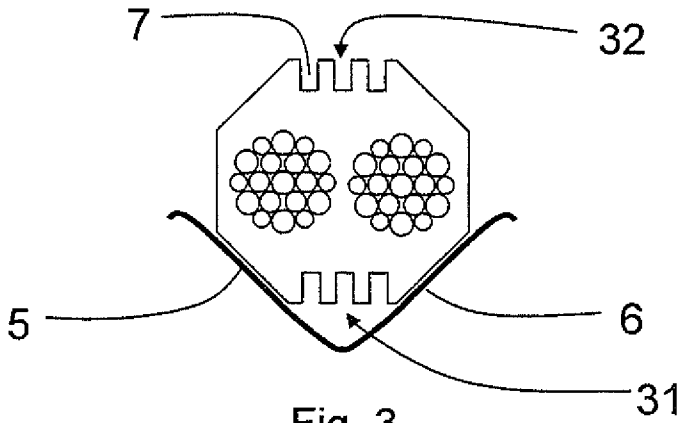
FIG. 3 shows a support element with a surface profile oriented longitudinally.

FIG. 3 similarly shows a support element which is polygonal in cross-section and which lies on a drive pulley. The support element has, at the upper side 32 and at the lower side 31, profiles formed in longitudinal direction. These can be formed in simple manner in the elastomeric casing, for example the polyurethane, during manufacture. The profiles have the advantage that they can accept dirt and debris which in a given case stays under the support element surface. In addition, they can serve as an indicator for the wear of the support element. In this connection it is advantageous that the support element has a height/width ratio of 1:1. It is thereby possible to substantially fully utilize the width by the tensile carriers arranged in the support element and to correspondingly profile the upper and lower surface. Sufficient material is present in the elastomeric casing for formation of the profile.

Figure 4:
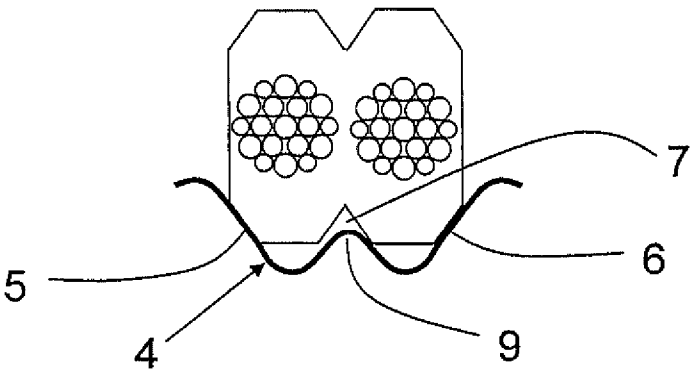
FIG. 4 shows a support element with a surface profile oriented longitudinally.

FIG. 4 shows a further exemplary support element which is polygonal in cross-section. In this connection, however, the side surfaces are not formed to be of equal length, but the horizontal and vertical sides have a larger area than the diagonal side surfaces. The upper and lower surfaces have a recess which in co-operation of a guide rail 9 ensures optimal positioning of the support element on the drive pulley. In that case no force is transmitted from the guide rail to the support element. Rather, this takes place by way of the support surfaces 5, 6 of the traction surface 4 of the drive pulley. The form of the polygonal cross-sectional shape in FIG. 4 is merely an example. Other embodiments are possible with different ratios of the horizontal to the diagonal side areas, as well as different shaping of the recesses 7 on the upper side 32 and lower side 31 of the support element.

Figure 5:
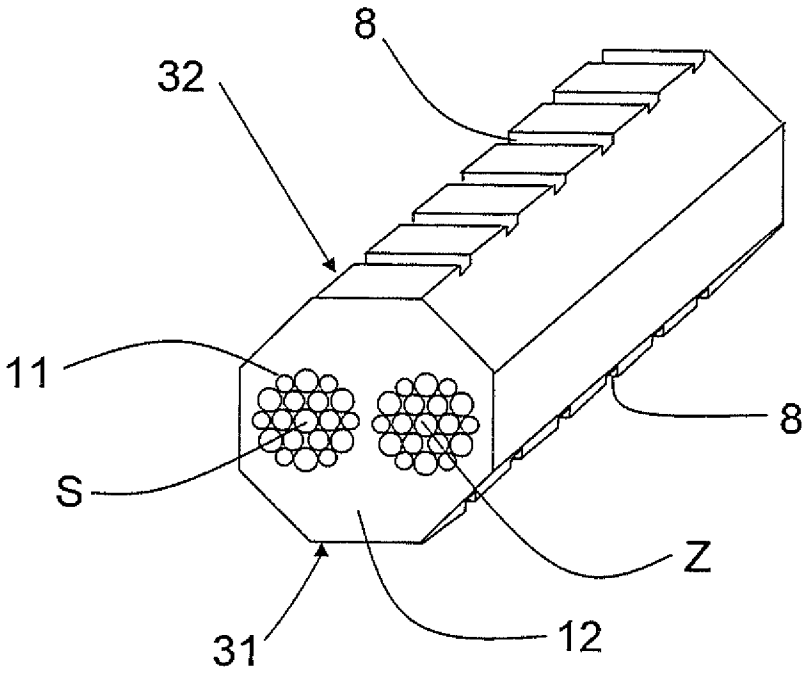
FIG. 5 shows a support element with a surface profile oriented transversely to the longitudinal direction.

FIG. 5 shows a further exemplary embodiment of the support element in which a polygonal cross-section was similarly selected, but in which the surfaces 32 and 31 are provided with a profile 8 oriented in transverse direction. The profile recesses can be disposed respectively opposite one another on the surfaces 31 and 32; they can also be formed at alternating spacing. The spacing is dependent on the size of the drive pulley. For example, four to six profile recesses of that kind are formed per drive pulley half circumference. The profiling has the advantage that the support element is more readily bendable, so that for the same bending capability a higher degree of hardness of the elastomeric material, for example of the polyurethane, can be selected. This increases service life and also improves the force transmission from the drive pulley to the support element. There is a lower degree of wear and also a lower coefficient of friction. In addition, a friction component which builds up and which arises when the support element runs over the drive pulley is interrupted. Overall, a lower coefficient of friction is thus achieved by a small friction area. This means that the cable can slip over the drive pulley. However, through the selective construction of the support surfaces the pressure able to be exerted by the drive pulley on the support element is high so that good traction is achieved. Through its special configuration the support element has a long service life and through the self-adjustment can advantageously be used particularly in cable rollers which are positioned at an angle, since due to the stabilization of the position of the cable by tensile carriers, cable unraveling is prevented even in an inclined position.

Having illustrated and described the principles of the disclosed technologies, it will be apparent to those skilled in the art that the disclosed embodiments can be modified in arrangement and detail without departing from such principles. In view of the many possible embodiments to which the principles of the disclosed technologies can be applied, it should be recognized that the illustrated embodiments are only examples of the technologies and should not be taken as limiting the scope of the invention. Rather, the scope of the invention is defined by the following claims and their equivalents. We therefore claim as our invention all that conies within the scope and spirit of these claims.

What is claimed is:

1. A support element system for elevators, comprising:

at least one support element having exactly two load-bearing tensile carriers, which are arranged in a horizontal orientation adjacent to one another and which are enclosed in a common elastomeric casing separating the two tensile carriers, wherein the tensile carriers respectively have an opposite direction of wrap, wherein a maximum width and a maximum height of a cross-section of the support element has a ratio of substantially 1:1, wherein a vertical orientation of the tensile carriers is to half the maximum height of the cross-section of the support element, the support element having two spaced apart planar traction surface regions extending in a longitudinal direction of the support element, each of the traction surface regions extending in a single plane angled relative to the vertical and horizontal orientations of the tensile carriers in the support element cross-section, and the traction surface regions connected by a lower side surface that is at least in part not angled relative to the vertical and horizontal orientations of the tensile carriers in the support element cross-section; and a drive pulley for transmission of a drive force to the at least one support element, wherein the drive pulley has a contoured traction surface with two spaced apart support surfaces which are provided for transmission of the drive force and which co-operate with the planar traction surface regions of the support element to transmit the entire drive force from the drive pulley to the support element, the drive pulley contoured traction surface extending between the support surfaces being spaced from and not contacting an entirety of the lower side surface of the support element when each of the two traction surface regions is in contact with an associated one of the support surfaces.

2. The support element system according to claim 1, wherein the support element co-operates with the two support surfaces of the traction surface in such a manner that forces transmitted from the drive pulley to the support element cross on an axis which is determined by a vertical axis of the support element.

3. The support element system according to claim 1, wherein the support element co-operates with the two support surfaces of the traction surface in such a manner that forces transmitted from the drive pulley to the support element cross on an axis which is determined by a vertical axis of the support element such that the forces run substantially through a center of gravity of the support element.

4. The support element system according to claim 1, wherein a projection of the cross-section of the at least one support element is formed with mirror-image symmetry horizontally and vertically.

5. The support element system according to claim 4, wherein a surface of the support element has a profile including a plurality of spaced apart recesses extending across the surface substantially transversely to a longitudinal axis of the support element.

6. The support element system according to claim 4, wherein a surface of the support element has a profile including a plurality of spaced apart recesses extending substantially parallel to a longitudinal axis of the support element.

7. The support element system according to claim 1, wherein a surface of the support element has a profile including a plurality of spaced apart recesses extending across the surface substantially transversely to a longitudinal axis of the support element.

8. The support element system according to claim 7, wherein the profile is arranged substantially on a surface side facing the traction surface of the drive pulley and on an opposite surface side.

9. The support element system according to claim 1, wherein a surface of the support element has a profile including a plurality of spaced apart recesses extending substantially parallel to a longitudinal axis of the support element.

10. The support element system according to claim 9, wherein the profile is arranged substantially on a surface side facing the traction surface of the drive pulley and on an opposite surface side.

* * * * *